US008061554B2

(12) United States Patent
Shikano

(10) Patent No.: US 8,061,554 B2
(45) Date of Patent: Nov. 22, 2011

(54) GARBAGE BIN AND LID FOR CONTAINER

(75) Inventor: Koji Shikano, Nerima-ku (JP)

(73) Assignee: Add Field Co., Ltd., Tokyo (JP)

( * ) Notice: Subject to any disclaimer, the term of this patent is extended or adjusted under 35 U.S.C. 154(b) by 307 days.

(21) Appl. No.: 12/377,127

(22) PCT Filed: Aug. 23, 2006

(86) PCT No.: PCT/JP2006/316493

§ 371 (c)(1),
(2), (4) Date: Feb. 11, 2009

(87) PCT Pub. No.: WO2008/023411

PCT Pub. Date: Feb. 28, 2008

(65) Prior Publication Data

US 2010/0176126 A1 Jul. 15, 2010

(51) Int. Cl.
*B65F 1/08* (2006.01)

(52) U.S. Cl. ..... 220/826; 220/264; 220/263; 220/908.1; 220/495.08

(58) Field of Classification Search ..... 220/263, 220/908.1, 264, 262, 495.08, 23.87, 23.91, 220/810, 776, 826

See application file for complete search history.

(56) References Cited

U.S. PATENT DOCUMENTS 27,909 A * 4/1860 Jeffers ..... 137/513
1,939,139 A * 12/1933 Schott ..... 220/263
2,271,918 A * 2/1942 Glowka ..... 220/23.87
3,193,133 A * 7/1965 Woodward ..... 220/776
5,520,303 A * 5/1996 Bernstein et al. ..... 220/495.08

FOREIGN PATENT DOCUMENTS

| | | |
|---|---|---|
| JP | 2 46703 | 3/1990 |
| JP | 3 70972 | 3/1991 |
| JP | 3089358 | 7/2002 |
| JP | 2006 160372 | 6/2006 |

OTHER PUBLICATIONS

Wikipedia, Silicone rubber, Feb. 22, 2011,Wikimedia Foundation, Inc., 4 pages.*

* cited by examiner

*Primary Examiner* — Stephen Castellano
(74) *Attorney, Agent, or Firm* — Oblon, Spivak, McClelland, Maier & Neustadt, L.L.P.

(57) ABSTRACT

A garbage bin in which, when the opening of a container in which garbage is placed is closed by a lid, odor emanating from the garbage does not leak to the outside from a gap between the container and the lid. The garbage bin includes an outer container, an inner container placed inside the outer container and in which garbage is placed, an openable/closable outer lid pivotally attached to the outer container and closing the opening of the outer container, and an inner lid attached to the lower surface of the outer lid and moving together with the outer lid. The lower surface of the inner lid is in intimate contact with the upper end of the inner container when the opening of the outer container is closed by the outer lid.

11 Claims, 8 Drawing Sheets

[Fig.1]
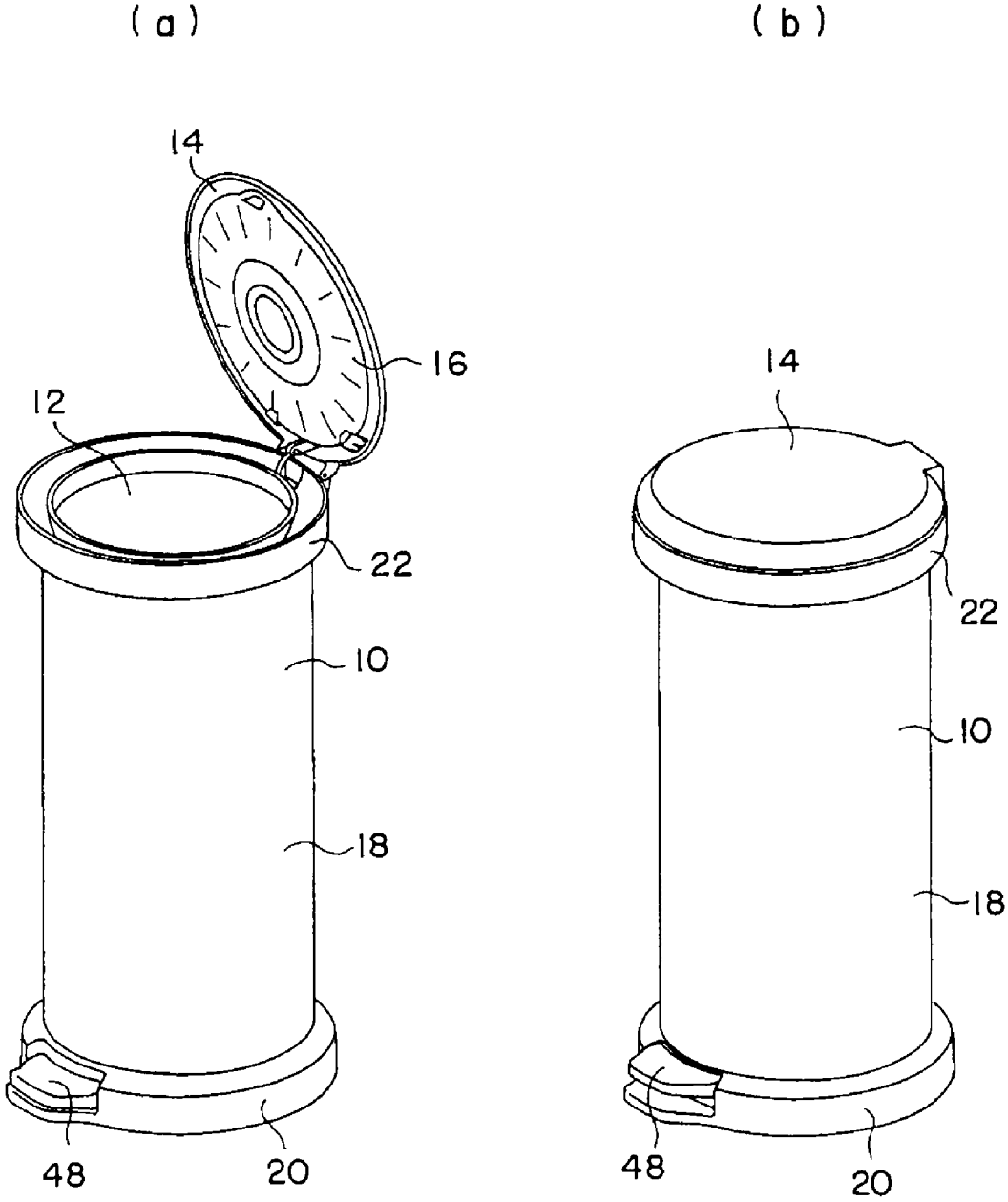

[Fig.2]
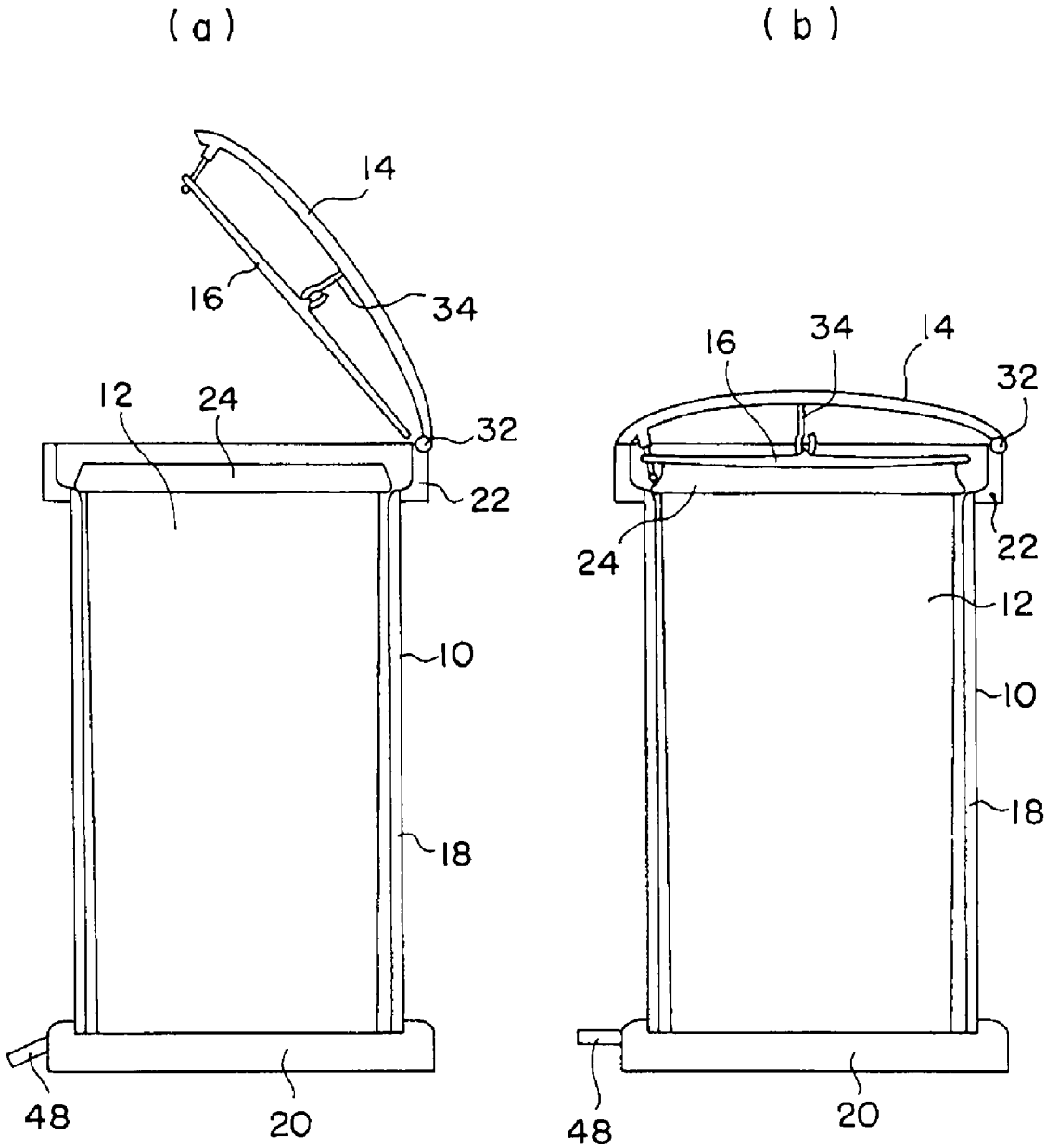

[Fig.3]
(a)
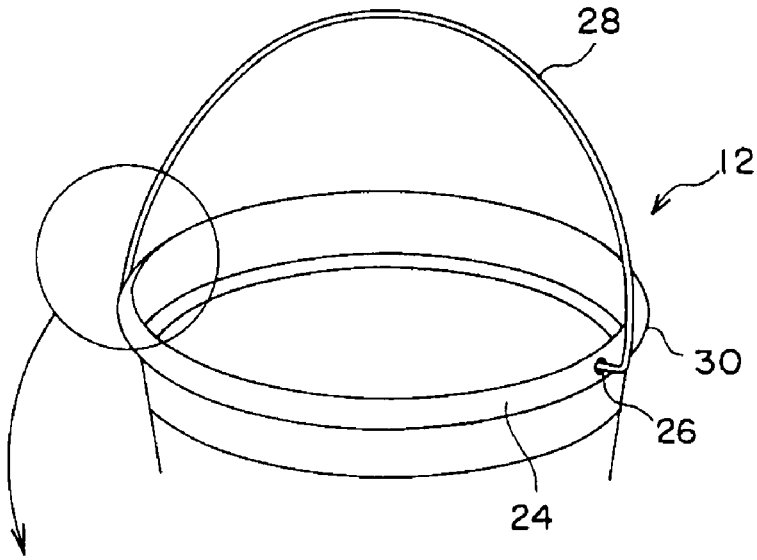
(b)
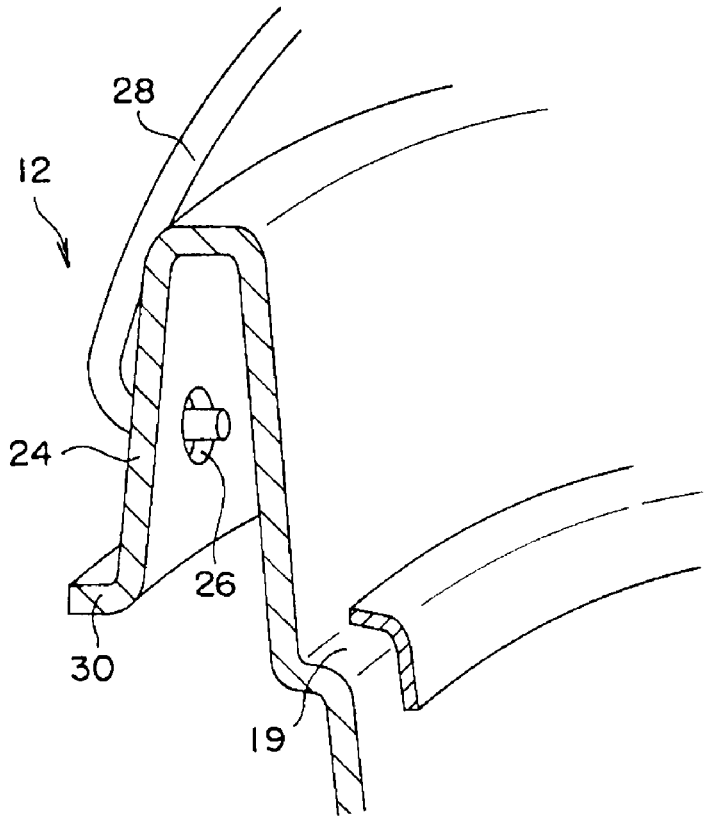

[Fig.4]
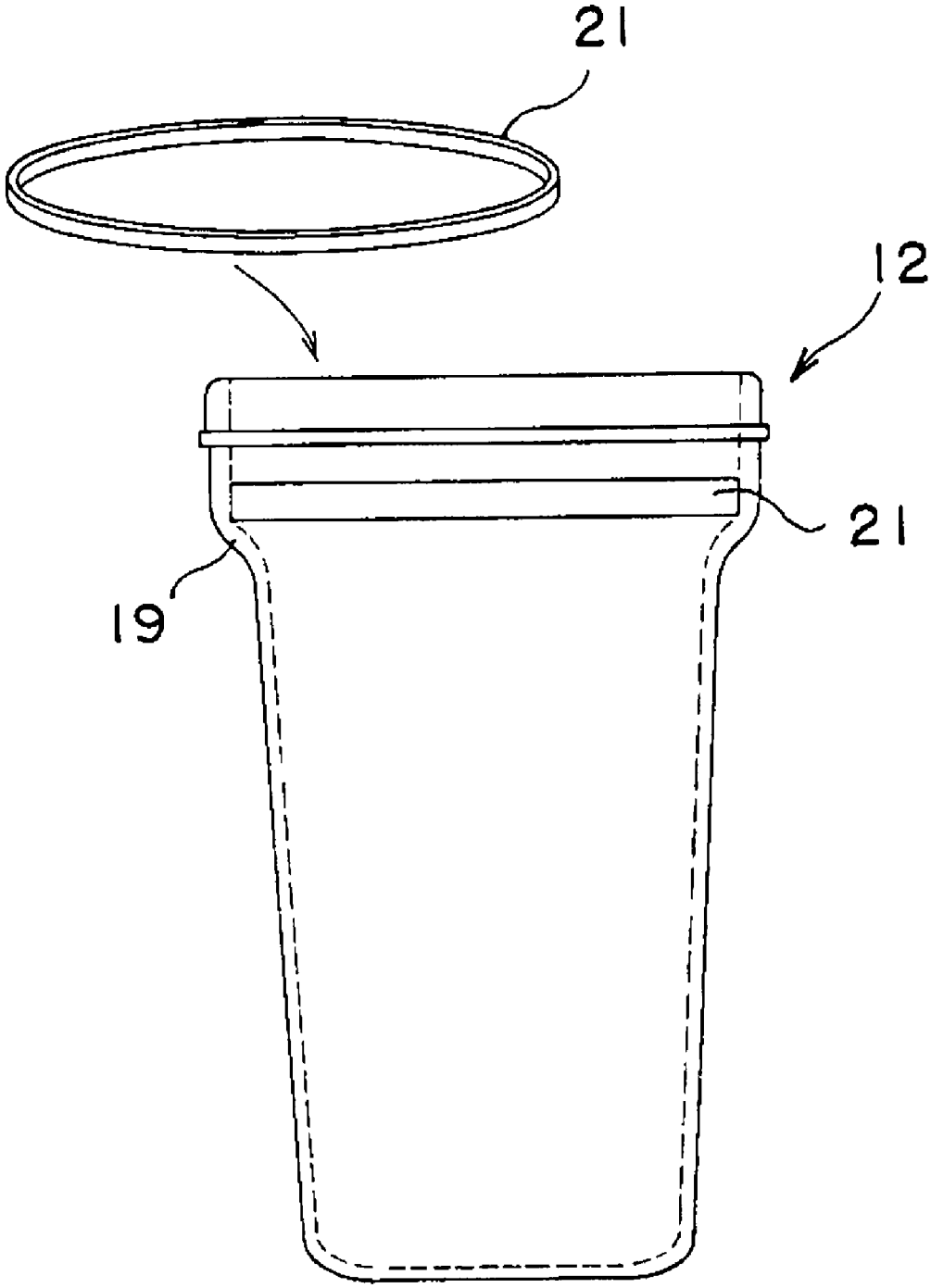

[Fig.5]
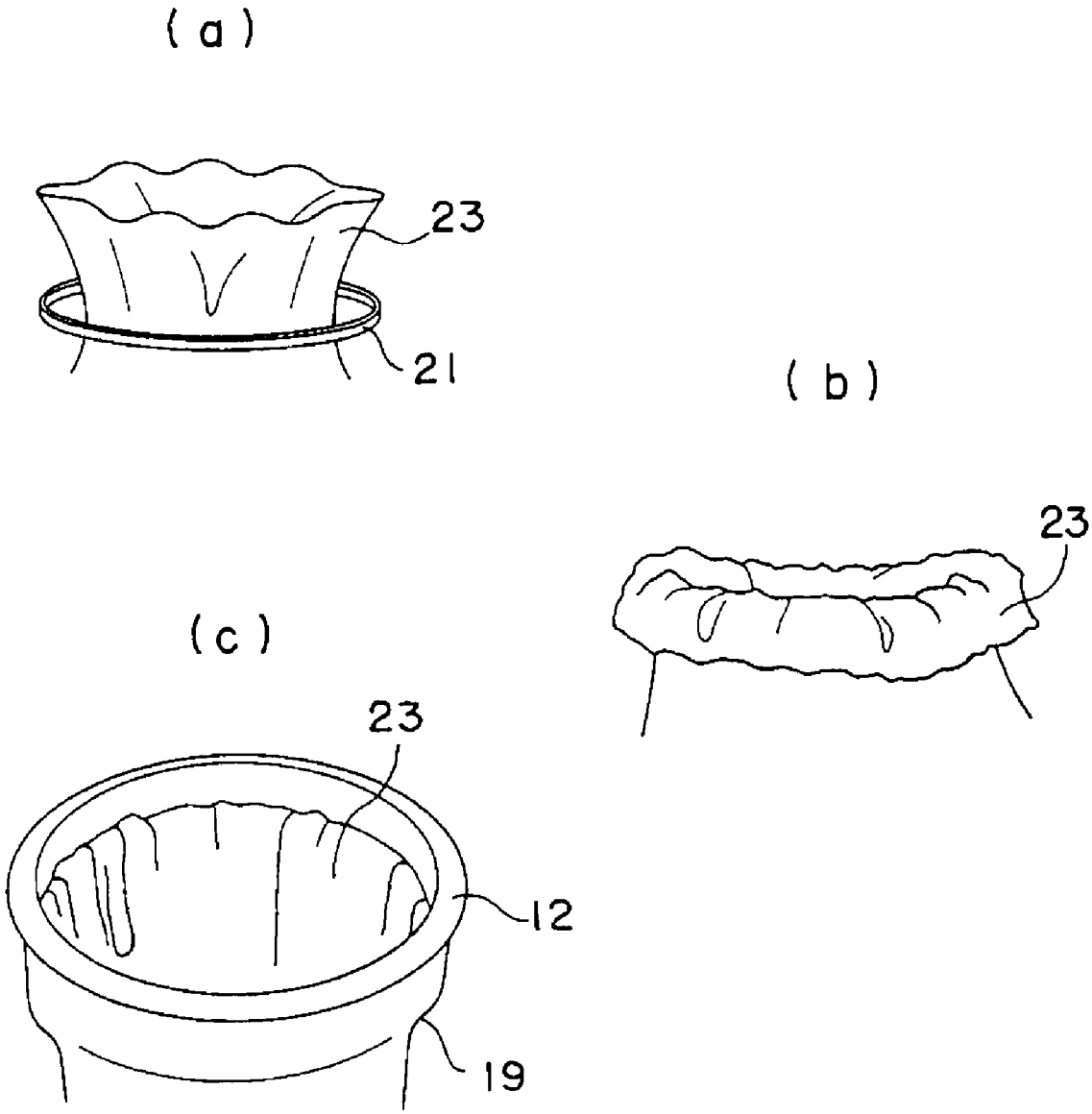

[Fig.6]
( a )
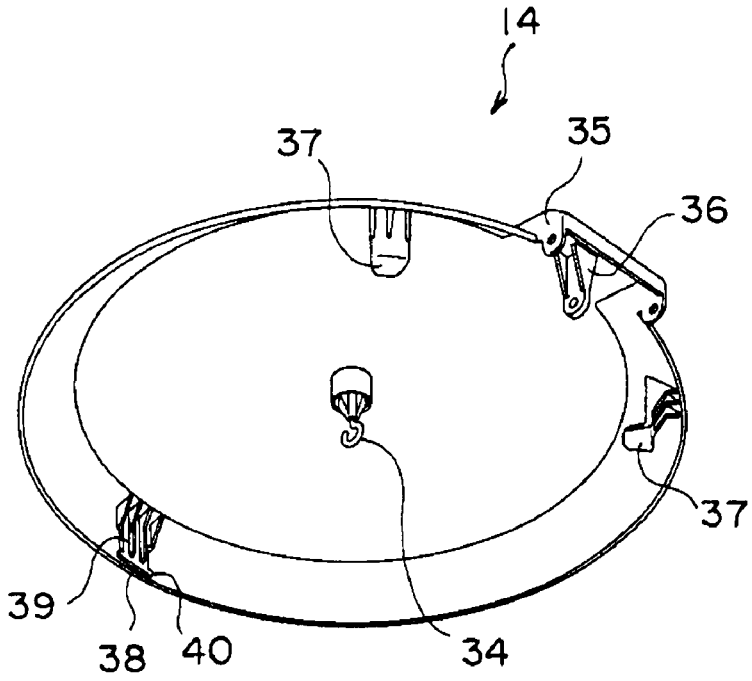
( b )
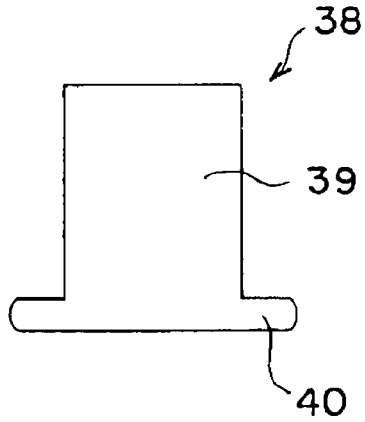

[Fig.7]
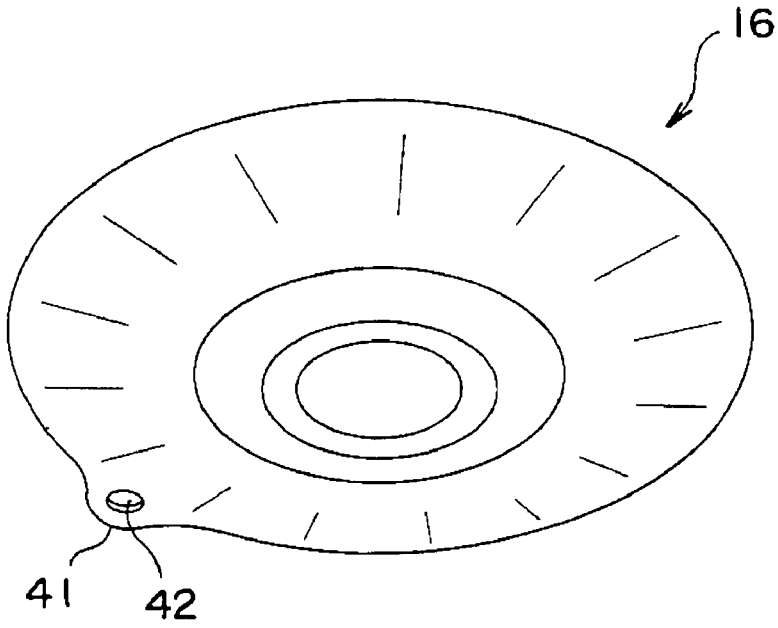
[Fig.8]
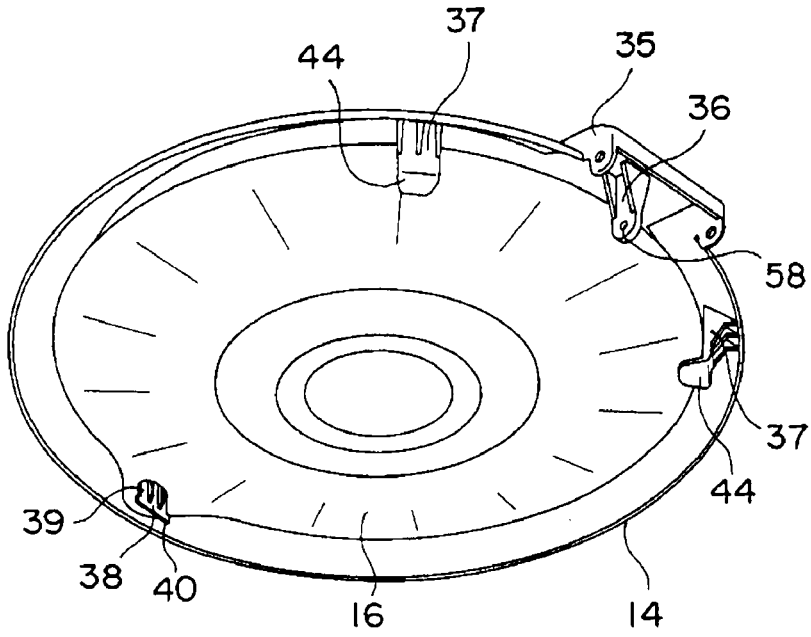

[Fig.9]
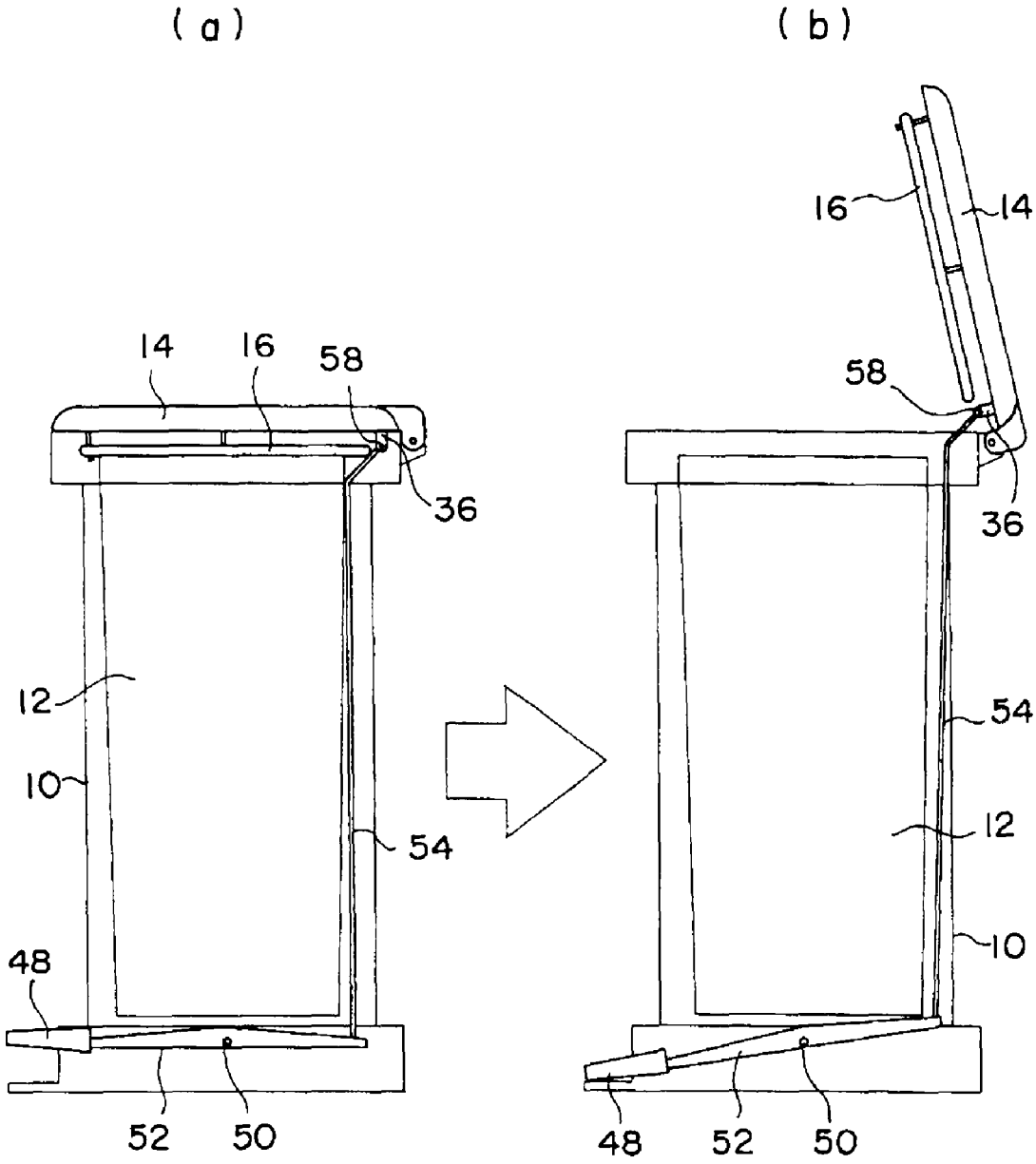

GARBAGE BIN AND LID FOR CONTAINER

TECHNICAL FIELD

The present invention relates to a garbage bin which has a container for placing garbage and a lid which closes the opening of said container. The present invention also relates to a lid which closes the opening of said container.

Background Art

Conventionally, a garbage bin having a container for placing garbage and a lid for closing the opening of said container is known (for example, Patent Reference 1).

Patent Reference 1: Unexamined Japanese Patent 1995-41105 Gazette

DISCLOSURE OF THE INVENTION

Problems to be Solved by the Invention

However, the conventional garbage bin having the conventional container and lid had the drawback wherein odor from the garbage would emanate from a gap between the container and lid formed when the opening of the container was closed with the lid.

The present invention was made in light of said situation and has the objective of providing a garbage bin which can prevent odor from emanating from a gap between the container and lid formed when the opening of the container was closed with the lid. The present invention also has the objective of providing a container lid which can prevent odor from emanating outside the container of the garbage bin or similar.

Means for Solving the Problems

To achieve the objectives described above, the present invention provides the garbage bin indicated in (1) to (8) below and the container lid indicated in (9) to (13) below.

(1) A garbage bin which is equipped with an outer container, an inner container placed inside said outer container and in which garbage is placed, an openable/closable outer lid pivotally attached to said outer container and closing the opening of said outer container, and an inner lid attached to the lower surface of said outer lid and moving together with said outer lid and which is characterized by the lower surface of said inner lid that comes into intimate contact with the upper end of said inner container when the opening of said outer container is closed with said outer lid.

(2) The garbage bin of (1) which is characterized by the inner lid having flexibility being made of silicone rubber.

(3) The garbage bin of (1) or (2) where the lower surface of the outer lid has a hook section in the central section, a hinge mounting section in the base section, and an inner lid mounting section in the extremity section, the upper surface of the inner lid has in its center a projecting piece with a hole formed in it, the extremity section of the inner lid has a hole formed in it, said hook section of said outer lid is inserted in said hole in the upper central section of said inner lid, and the inner lid mounting section of said outer lid is inserted in the hole in the extremity section of said inner lid, and which is characterized by the inside of the inner container being placed under negative pressure due to said hook section pressing the inner lid downward when the lower surface of the inner lid is in intimate contact with the upper end of the inner container, and by the inside of the inner container being opened to the air by said inner lid mounting section lifting up the extremity section of the inner lid when the outer lid and inner lid are opened.

(4) The garbage bin of (3) which is characterized by the inner lid mounting section of said outer lid consisting of a wide section connected to the lower end of the flat section, with the width of said flat section being shorter than the diameter of the hole at the extremity section of said inner lid, and the width of said wide section being longer than the diameter of the hole at the extremity section of said inner lid.

(5) The garbage bin of (1) to (4) which is characterized by an inner lid holding section having an L-shaped cross section located near the base section on the lower surface of said outer lid, and by the horizontal section of said inner lid holding section being located downward of said inner lid.

(6) The garbage bin of (1) to (5) which is characterized by a folded-back section folded back to the outside installed at the upper end of the inner container, and by a hole being formed at said folded-back section and both ends of a handle being inserted into said hole.

(7) The garbage bin of (1) to (6) which is characterized by a stepped section molded to bulge inward slightly downward of the upper end of the inner container and by the attachment to the inner container of a ring for fastening a garbage bag, which is to be positioned on said stepped section.

(8) The garbage bin of (1) to (7) which is characterized by having a pedal installed at the lower section of the outer container, and by having the outer lid and inner lid open together by stepping on said pedal with a foot.

(9) A container lid where it is a lid of a container comprised of an outer container and an inner container positioned inside said outer container, and is equipped with an openable/closable outer lid pivotally attached to said outer container and closing the opening of said outer container, and an inner lid attached to the lower surface of said outer lid and moving together with said outer lid, and which is characterized by the lower surface of the inner lid being in intimate contact with the upper end of said inner container when the opening of said outer container is closed by said outer lid.

(10) The container lid of (9) which is characterized by its inner lid having flexibility being made of silicone rubber.

(11) The container lid of (9) or (10) wherein the lower surface of the outer lid has a hook section in the central section, a hinge mounting section in the base section, and an inner lid mounting section in the extremity section, the upper surface of the inner lid has in its center a projecting piece with a hole formed in it, the extremity section of the inner lid has a hole formed in it, said hook section of said outer lid is inserted in said hole in the upper central section of said inner lid, and the inner lid mounting section of said outer lid is inserted in the hole in the extremity section of said inner lid, and which is characterized by the inside of the inner container being placed under negative pressure due to said hook section pressing the inner lid downward when the lower surface of the inner lid is in intimate contact with the upper end of the inner container, and by the inside of the inner container being opened to the air by said inner lid mounting section lifting up the extremity section of the inner lid when the outer lid and inner lid are opened.

(12) The container lid of (11) which is characterized by the inner lid mounting section of said outer lid consisting of a wide section connected to the lower end of the flat section, with the width of said flat section being shorter than the diameter of the hole at the extremity section of said inner lid, and the width of said wide section being longer than the diameter of the hole at the extremity section of said inner lid.

(13) The container lid of (9) to (12) which is characterized by an inner lid holding section having an L-shaped cross section located near the base section on the lower surface of the outer lid, and by the horizontal section of said inner lid holding section being located downward of said inner lid.

With the garbage bin of the present invention, the lower surface of the inner lid is in intimate contact with the upper end of the inner container when the opening of the outer container is closed with the outer lid, wherefore no gap is formed between the inner container and the inner lid, wherefore the odor emanating from the garbage placed in the inner container does not leak to the outside. The container lid of the present invention, owing to no gap being formed between the inner container and the inner lid owing to the lower surface of the inner lid being in intimate contact with the upper end of the inner container when the opening of the outer container is closed with the outer lid, can prevent the odor emanating from the garbage placed in the inner container from leaking to the outside.

Effect of the Invention

With the garbage bin of the present invention, odor emanating from garbage does not leak outside from a gap between the container and the lid when the opening of the container in which garbage is placed is closed with the lid. The container lid of the present invention can prevent odor emanating from objects placed in the container from leaking to the outside.

BRIEF DESCRIPTION OF THE DRAWINGS

FIG. 1 illustrates an embodiment of the invention, with (a) being a perspective view illustrating the lid in an open state, and (b) being a perspective view illustrating the lid in a closed state.

FIG. 2 (a) is a cross-sectional view illustrating the garbage bin in FIG. 1 with the lid in an open state, and (b) is a cross-sectional view illustrating the garbage bin in FIG. 1 with the lid in a closed state.

FIG. 3 (a) is a perspective view illustrating the upper section of the inner container of the garbage bin in FIG. 1, and (b) is an enlarged cross-sectional view illustrating the upper section of said inner container.

FIG. 4 is a front view which gives a schematic illustration of the inner container of the garbage bin in FIG. 1.

FIG. 5 (a) to (c) are explanatory drawings illustrating how a garbage bag is attached to the garbage bag holding ring and placed within the inner container.

FIG. 6 is a perspective view illustrating the lower surface of the outer lid.

FIG. 7 is a perspective view illustrating the lower surface of the inner lid.

FIG. 8 is a perspective view illustrating the inner lid mounted onto the lower surface of the outer lid.

FIG. 9 (a) is an explanatory drawing illustrating the garbage bin in FIG. 1 with the lid in a closed state, and (b) is an explanatory drawing illustrating the garbage bin in FIG. 1 with the lid in an open state.

BEST MODE(S) FOR CARRYING OUT THE INVENTION

The modes for carrying out the invention will be explained in reference to the drawings; however, the invention is not limited to the examples given below. FIG. 1 and FIG. 2 illustrate modes for carrying out the garbage bin relating to the invention, with FIG. 1 (a) being a perspective view showing the lid in an open state, FIG. 1 (b) being a perspective view showing the lid in a closed state, FIG. 2 (a) being a cross-sectional view showing the lid in an open state, and FIG. 2 (b) being a cross-sectional view showing the lid in a closed state. The garbage bin in this example is equipped with an outer container (10), an inner container (12) which is placed inside outer container (10) and within which garbage is placed, an openable/closable outer lid (14) which is pivotally attached to the outer container (10) and which closes the opening of the outer container (10), and an inner lid (16) which is attached to the lower surface of outer lid (14) and which moves together with outer lid (14).

The outer container (10) is of an approximately cylindrical bottomed configuration wherein plastic platform (20) is fixed at the lower end of stainless steel cylinder (18), and plastic ring-shaped flange (22) is fixed at the upper end of cylinder (18). The inner diameter of the ring-shaped flange (22) is made so that it is larger than the inner diameter of cylinder (18) and the diameter of inner lid (16), and inner lid (16) is capable of being placed within the ring-shaped flange (22).

The inner container (12) is of an approximately cylindrical bottomed configuration molded in one piece with plastic. The outer diameter of the inner container (12) except for the folded-back section (24) which will be described later, is smaller than the inner diameter of cylinder (18) of the outer container (10). Additionally, as shown in FIG. 3, the inner container (12) has a folded-back section (24), folded back to the outside, installed at the upper end, and a circular hole (26) is formed at the folded-back section (24), and both ends of an approximately semicircular metal handle (28) are inserted into the circular hole (26). Furthermore, the outer rim (30) of the folded-back section (24) of the inner container (12) is in close proximity to the upper end of the cylinder (18) of the outer container (10).

Also, as shown in FIG. 3 and FIG. 4, a stepped section (19) which bulges inward is formed slightly downward of the upper end of the inner container (12), and a ring (21) for fastening a garbage bag which is to be positioned on said stepped section (19) is attached to the inner container (12). As shown in FIG. 5 (a), the upper section of a garbage bag (23) is pulled through the ring (21) for fastening a garbage bag, and as shown in FIG. 5 (b), the upper section of the garbage bag (23) is folded back to the outside, whereupon the garbage bag (23) is placed within the inner container (23) as shown in FIG. 5 (c), and, by positioning the ring (21) for fastening a garbage bag on the stepped section (19), the garbage bag (23) can be placed within the inner container (12).

The outer lid (14) is of an approximately circular shape and molded in one piece of plastic, and is pivotally attached to the outer container (10) by means of a hinge (32). On the lower surface of the outer lid (14), as shown in FIG. 6 (a), are installed: in the central section, a hook section 34 with a curved extremity section and of a prescribed length; at the base section, a hinge mounting section (35) and shaft mounting section (36); close to the base section, two inner lid holding sections (37, 37), which have L-shaped cross sections; and at the extremity section, an inner lid mounting section (38). Said inner lid mounting section (38), as shown in FIG. 6 (b), consists of a wide section (40) which is wider than a flat section (39) being connected to the lower end of said flat section (39).

The inner lid (16) is of an approximately circular shape and has flexibility being molded in one piece of silicone rubber. As shown in FIG. 7, a bulging section (41) is located at the extremity section of the inner lid (16), and in the bulging section (41) an oval hole (42) is formed. Also, although it is not illustrated in a drawing, a projecting piece is attached to the center of the upper surface of inner lid (16) and a circular hole is formed in the projecting piece, and the curved section of the extremity section of hook section (34) of the outer lid (14) is inserted into the circular hole. Furthermore, as shown in FIG. 8, to said oval hole (42) the flat section (39) of the inner lid mounting section (38) of the outer lid (14) is inserted so that the direction of the major axis of the oval hole (42) and the direction of the width of the flat section (39) are consistent with each other, and the horizontal section (44) of the inner lid holding sections (37, 37) of the outer lid (14) is located downward of the inner lid (16). In this case, the width of the flat section (39) of the inner lid mounting section (38) is shorter than the major axis of the oval hole (42), and the width of the wide section (40) of the inner lid mounting section (38) is longer than the major axis of the oval hole (42), wherefore the flat section (39) is capable of sliding within the oval hole (42), and the inner lid mounting section (38) is prevented by the wide section (40) from slipping out of the oval hole (42). FIG. 8 shows one mode for carrying out the container lid relating to the invention.

For the inner lid, the mode for carrying out the invention described in Unexamined Japanese Patent 2006-160372 Gazette can be used optimally. Said Gazette discloses a container lid wherein the container lid has an outer surface and an inner surface which is capable of coming into contact with the container which is to be sealed, the lid is made of silicone material, the lid includes a central section and a perimeter section which surrounds said central section, the thickness of the perimeter section being 2.0 mm to 4.0 mm, and the thickness of said central section is greater than the thickness of said perimeter section. For the inner lid, the UFO Wrap (product name) sold by Kawashima Kougyou Co., Ltd. can be used optimally.

With the garbage bin of the present embodiment, a pedal (48) is located at the platform (20) of the outer container (10), and by stepping on the pedal (48) with a foot the outer lid (14) and inner lid (16) are made to open together. More specifically, as shown in FIG. 9, one end of a rotating disc (52) which rotates around the axis section (50) is connected to the pedal (48), and the lower end of a metal shaft (54) is connected to the other end of the rotating disc (52), and the hook section at the upper end of the shaft (54) is inserted into the shaft insertion hole (58) located in the shaft mounting section (36) of the outer lid (14). When the pedal (48) is stepped on with a foot, the other end of the rotating disc (52) lifts up and pushes up the shaft (54), the shaft (54) pushes up the outer lid (14), and the outer lid (14) and the inner lid (16) are made to open together.

With the garbage bin in the present mode for carrying out the invention, as shown in FIG. 2 (b), the lower surface of the inner lid (16) is in intimate contact with the upper end of the inner container (12) when the opening of the outer container (10) is closed by the outer lid (14).

The characteristics of the garbage bin in the present mode for carrying out the invention described above are (1) through (5) below.

(1) When the opening of the outer container (10) is closed with the outer lid (14), the lower surface of the inner lid (16) is in intimate contact with the upper end of the inner container (12), wherefore no gap is formed between the inner container (12) and the inner lid (16), wherefore no odor from the garbage placed in the inner container (12) leaks to the outside. In this case, the hook section (34) of the outer lid (14) has a prescribed length and pushes down the inner lid (16) with a proper amount of pressure, wherefore the inner lid (16) in a generally flexed state is brought strongly into intimate contact with the upper end of the inner container (12), as a result of which the inside of the inner container (12) is put under negative pressure, and the inner container (12) is completely sealed by means of the inner lid (16). Additionally, owing to the flat section (39) of the inner lid mounting section (38) of the outer lid (14) being capable of sliding within the oval hole (42), the inner lid mounting section (38) does not press down on the inner lid (16) more than necessary, wherefore a gap is not formed between the inner container (12) and the inner lid (16) owing to flexing of the extremity side of the inner lid (16). When the length of the flat section (39) is too short, the extremity side of the inner lid (16) may become suspended, allowing a gap to form between the inner container (12) and the inner lid (16), wherefore there is a need to make the flat section (39) an appropriate length. Additionally, the flat section (39) only has to be capable of sliding within the oval hole (42), and can be of another configuration such as a rod shape. Additionally, when the pedal (48) is stepped on with a foot to open the outer lid (14) and the inner lid (16), the wide section (40) of the inner lid mounting section (38) of the outer lid (14) lifts up the extremity section of the inner lid (16), and as a result a gap is formed between the extremity section of the inner lid (16) and the inner container (12), allowing the inside of the inner container (12) to be opened to the air, wherefore the inner container (12) does not adhere to the inner lid (16) and lifted up. Additionally, after opening the outer lid (14) and the inner lid (16) and placing garbage into the inner container (12), the outer lid (14) and inner lid (16) are pushed shut with a hand, but because the horizontal section (44) of the inner lid holding sections (37, 37) of the outer lid (14) is located downward of the inner lid (16), the base section of the inner lid (16) does not dangle and become caught on the inner container.

(2) On the upper end of the inner container (12) a folded-back section (24) folded back toward the outside is located, and a circular hole (26) is formed in this folded-back section (24), and both ends of a handle (28) are inserted into this circular hole (26). This is because, when a through hole is formed in the section of the inner container (12) which holds garbage, the interior of the inner container (12) is not placed under negative pressure when the lower surface of the inner lid (16) is placed in intimate contact with the upper end of the inner container (12), wherefore the inner container (12) is not sealed with the inner lid (16) and the odor from the garbage leaks to the outside through said through hole. It is also acceptable not to have said folded-back section (24) on the inner container (12) but to form a non-penetrating concave section at the upper section of the inner container (12), and insert both ends of the handle into this concave section.

(3) A stepped section (19) which bulges inward is formed slightly downward of the upper end of inner container (12), and a ring (21) for fastening a garbage bag which is placed on stepped section (19) of inner container (12) is attached, and a garbage bag (23) is placed within the inner container (12) by means of the method shown in FIG. 5. This is because, although garbage bags are usually placed within the inner container (12) in a state where the garbage bag is folded back to the outside at the upper end of the inner container (12), doing so would allow the garbage bag to come between the inner container (12) and the inner lid (16), making it impossible for the lower surface of inner lid (16) to be in intimate contact with the upper end of the inner container (12).

(4) A ring-shaped flange (22) is fixed at the upper end of the cylinder (18) of the outer container (10), with the inner diameter of the ring-shaped flange (22) being made larger than the inner diameter of the cylinder (18) and the diameter of the inner lid (16). This is for the purpose of creating space to hold the inner lid (16) within the upper end section of the outer container (10).

(5) The outer rim (30) of the folded-back section (24) of the inner container (12) is made to be in close proximity to the upper end of the cylinder (18) of the outer container (10). This is for the purpose of securing enough space to place the inner lid (16) within the upper end section of the outer container (10) while preventing garbage from entering a gap between the outer container (10) and the inner container (12). When the folded-back section (24) is not formed on the inner container (10), the upper end of the inner container (12) needs only to be placed in close proximity to the cylinder (18) of the outer container (10).

The garbage bin in the invention is not limited to the modes for carrying out the invention described above but can be modified in various ways as necessary. For example, in the mode for carrying out the invention described above, the outer lid and inner lid are opened by means of stepping on a pedal with a foot, but the outer lid and inner lid can be made so that they are opened by lifting with a hand. Additionally, in the mode for carrying out the invention described above the inner container, outer container, outer lid, and inner lid are circular in shape, but these can be other shapes as well, for example, triangular, square, oval, etc. Furthermore, the configuration, dimensions, etc., of the hook section, inner lid holding section, and inner lid mounting section of the outer lid, the hole in the extremity section of the inner lid, and the projecting piece with a hole formed in the center of the upper surface of the inner lid, can be specified as appropriate.

The container lid relating to the present invention, as shown in FIG. 8, comprises an inner lid mounted to an outer lid. The container lid relating to the present invention can be applied for containers other than garbage bins, as long as the container is comprised of an outer container and an inner container which is located inside the outer container.

The invention claimed is:

1. A garbage bin comprising:

an outer container;

an inner container placed inside said outer container and in which garbage is placed;

an openable/closable outer lid pivotally attached to said outer container and closing an opening of said outer container; and an inner lid attached to a lower surface of said outer lid and moving together with said outer lid, and wherein a lower surface of said inner lid comes into intimate contact with an upper end of said inner container when the opening of said outer container is closed with said outer lid, wherein the lower surface of the outer lid includes a hook section in a central section, a hinge mounting section in a base section, and an inner lid mounting section in an extremity section, an upper surface of the inner lid includes in its center a projecting piece with a hole formed in it, the extremity section of the inner lid includes a hole formed in it, said hook section of said outer lid is inserted in said hole in the upper central section of said inner lid, and the inner lid mounting section of said outer lid is inserted in the hole in the extremity section of said inner lid, and wherein the inside of the inner container is placed under negative pressure due to said hook section pressing the inner lid downward when the lower surface of the inner lid is in intimate contact with the upper end of the inner container, and the inside of the inner container is opened to the air by said inner lid mounting section lifting up the extremity section of the inner lid when the outer lid and inner lid are opened.

2. The garbage bin described in claim 1, wherein the inner lid has flexibility being made of silicone rubber.

3. The garbage bin described in claim 1, wherein the inner lid mounting section of said outer lid includes a wide section connected to a lower end of a flat section, with the width of said flat section being shorter than the diameter of the hole at the extremity section of said inner lid, and the width of said wide section being longer than the diameter of the hole at the extremity section of said inner lid.

4. The garbage bin described in claim 1, further comprising an inner lid holding section having an L-shaped cross section located near the base section on the lower surface of said outer lid, and a horizontal section of said inner lid holding section being located downward of said inner lid.

5. The garbage bin described in claim 1, further comprising a folded-back section folded back to the outside installed at an upper end of the inner container, and a hole being formed at said folded-back section and both ends of a handle being inserted into said hole.

6. The garbage bin described in claim 1, further comprising a stepped section molded to bulge inward slightly downward of an upper end of the inner container and by attachment to the inner container of a ring for fastening a garbage bag, which is to be positioned on said stepped section.

7. The garbage bin described in claim 1, further comprising a pedal installed at a lower section of the outer container, and by having the outer lid and inner lid open together by stepping on said pedal with a foot.

8. A container lid configured for use with a container including an outer container and an inner container positioned inside said outer container, comprising:

an openable/closable outer lid configured to be pivotally attached to said outer container and configured to close an opening of said outer container; and an inner lid attached to a lower surface of said outer lid and moving together with said outer lid, and wherein a lower surface of the inner lid is configured to be in intimate contact with an upper end of said inner container when the opening of said outer container is closed by said outer lid, wherein the lower surface of the outer lid includes a hook section in a central section, a hinge mounting section in a base section, and an inner lid mounting section in an extremity section, an upper surface of the inner lid includes in its center a projecting piece with a hole formed in it, the extremity section of the inner lid includes a hole formed in it, said hook section of said outer lid is inserted in said hole in the upper central section of said inner lid, and the inner lid mounting section of said outer lid is inserted in the hole in the extremity section of said inner lid, and wherein the inside of the inner container is placed under negative pressure due to said hook section pressing the inner lid downward when the lower surface of the inner lid is in intimate contact with the upper end of the inner container, and by the inside of the inner container being opened to the air by said inner lid mounting section lifting up the extremity section of the inner lid when the outer lid and inner lid are opened.

9. The container lid described in claim 8, wherein the inner lid has flexibility being made of silicone rubber.

10. The container lid described in claim 8, wherein the inner lid mounting section of said outer lid includes a wide section connected to a lower end of a flat section, with the width of said flat section being shorter than the diameter of the hole at the extremity section of said inner lid, and the width of said wide section being longer than the diameter of the hole at the extremity section of said inner lid.

11. The container lid described in claim 8, further comprising an inner lid holding section having an L-shaped cross section located near the base section on the lower surface of the outer lid, and a horizontal section of said inner lid holding section being located downward of said inner lid.

* * * * *